US007883079B2

(12) United States Patent
Sato et al.

(10) Patent No.: US 7,883,079 B2
(45) Date of Patent: Feb. 8, 2011

(54) SHEET PROCESSING APPARATUS

(75) Inventors: Koki Sato, Tsukubamirai (JP); Satoshi Iwama, Minamiarupusu (JP); Eiji Fukasawa, Minamikoma-gun (JP); Hisashi Osada, Nirasaki (JP); Shin Tsugane, Hokuto (JP)

(73) Assignee: Canon Finetech Inc., Misato-Shi (JP)

( * ) Notice: Subject to any disclaimer, the term of this patent is extended or adjusted under 35 U.S.C. 154(b) by 165 days.

(21) Appl. No.: 12/356,730

(22) Filed: Jan. 21, 2009

(65) Prior Publication Data

US 2009/0189327 A1 Jul. 30, 2009

(30) Foreign Application Priority Data

Jan. 24, 2008 (JP) ..... 2008-014292
Jan. 24, 2008 (JP) ..... 2008-014293
Jan. 24, 2008 (JP) ..... 2008-014294

(51) Int. Cl.
*B65H 37/04* (2006.01)

(52) U.S. Cl. ..... 270/32; 493/444; 493/445

(58) Field of Classification Search ..... 270/32, 270/37; 493/444, 445
See application file for complete search history.

(56) References Cited

U.S. PATENT DOCUMENTS 5,154,411 A 10/1992 Saito et al. ..... 271/289
5,713,060 A 1/1998 Sato et al. ..... 399/20
7,344,130 B2 * 3/2008 Kamiya et al. ..... 270/37
7,578,497 B2 * 8/2009 Kawata et al. ..... 270/37
7,658,372 B2 * 2/2010 Kubo ..... 270/37
2007/0052148 A1 * 3/2007 Kubo ..... 270/58.08
2007/0161489 A1 * 7/2007 Ikeda et al. ..... 493/444

FOREIGN PATENT DOCUMENTS

JP 11011783 A * 1/1999
JP 2006248686 A * 9/2006

* cited by examiner

*Primary Examiner*—Patrick Mackey
(74) *Attorney, Agent, or Firm*—Fitzpatrick, Cella, Harper & Scinto

(57) ABSTRACT

A sheet processing apparatus including: a stack tray on which a sheet successively delivered from a delivery port is stacked, the stack tray including: a folding route receiving the sheet from the delivery port; a sheet folding device provided in the folding route to fold the sheet; and a sheet stacking surface for stacking the sheet, wherein the sheet processing apparatus is operable in selectively between a first mode in which a sheet from the delivery port is stacked on the sheet stacking surface, and a second mode in which a sheet folded by the sheet folding device is stacked on the same sheet stacking surface as in the first mode.

20 Claims, 12 Drawing Sheets

SHEET PROCESSING APPARATUS

BACKGROUND OF THE INVENTION

1. Field of the Invention

The present invention relates to a sheet processing apparatus for performing a processing such as bookbinding, punching, or stamping on sheets delivered from an image forming apparatus such as a copying machine or a printer; in particular, the present invention relates to a sheet processing apparatus in which multiple trays for accommodating sheet bundles are arranged in a limited space in an image forming apparatus and in which sheet bundles are stacked and accommodated on a tray selected through switching in accordance with the processing mode.

2. Description of the Related Art

A sheet processing apparatus includes a processing tray provided at the discharge port of an image forming apparatus such as a copying machine or a printer, and this processing tray is provided with processing apparatuses such as a stapling apparatus, a punching apparatus, and a stamping apparatus. Such a sheet processing apparatus, which performs processing on a series of sheets discharged from the image forming apparatus, is widely used as an apparatus for accommodating processed sheets on an accumulating tray on the downstream side. Recently, there has been proposed an apparatus which, when accommodating sheets on an accommodating tray by the processing apparatus, folds the sheets into a booklet.

As a conventional apparatus for folding sheets into a booklet when accommodating the sheets, there is known a processing apparatus installed on the downstream side of an image forming apparatus, the processing apparatus including a first tray accommodating sheets discharged from the image forming apparatus without performing any processing thereon, and a second tray which accommodates processed sheets (bundle) in a folded state (see, for example, Japanese Patent Application Laid-Open No. H11-11783). In the sheet processing apparatus disclosed in the above-mentioned publication, switching is selectively effected between a first tray and a second tray serving as discharge trays. The selected discharge tray is vertically moved, and is matched with a processing tray arranged on the upstream side.

When folding a sheet bundle that has undergone binding processing on a tray, the sheets aligned and accumulated on the processing tray are conventionally folded by a sheet folding mechanism, with the sheets being dropped for accommodation from a discharge port arranged above the tray, as disclosed in Japanese Patent Application Laid-Open No. H11-11783. That is, a discharge port is provided above the tray, and the sheets are caused to fall from the discharge port starting with the folded ends thereof to be further stacked on sheets that have already been stacked.

As another example of a sheet processing apparatus, there is known a layout construction in which a discharge port is arranged above an image forming unit, with an image reading unit being arranged further above (see, for example, Japanese Patent Application Laid-Open No. 2006-248686). In this disclosed example, a processing unit for performing stapling on accumulated sheet bundles is arranged at the discharge port between the image forming unit and the image reading unit.

In the unit construction of the sheet processing apparatus disclosed in Japanese Patent Application Laid-Open No. H11-11783, the apparatus housings of the image forming apparatus and the sheet processing apparatus are successively arranged so as to be adjacent to each other. Thus, a large installation space is required, resulting in an increase in the size of the system as a whole.

In view of this, in Japanese Patent Application Laid-Open No. 2006-248686, there is adopted a layout construction in which a processing unit is mounted in an image forming unit, thereby achieving a reduction in the system installation space.

However, in the construction disclosed in Japanese Patent Application Laid-Open No. H11-11783, an increase in the size of the system as a whole is involved as described above. Further, in the unit construction of Japanese Patent Application Laid-Open No. H11-11783, the stapling position where the sheets (sheet bundle) accumulated on the tray are bound together and the position of a folding blade (folding knife) for folding the sheet bundle are the same. Therefore, the layout construction of the two apparatuses are rather complicated, which leads to a rather difficult apparatus assembling operation at the time of production and a problem in terms of product reliability.

In view of this, by adopting a layout construction in which the processing unit is mounted on the image forming unit, it might be possible to perform binding (stapling) on the center of a sheet bundle, folding the sheet bundle, and accommodating the sheet bundle on the discharge tray in a folded state. In this layout, however, the accommodation of processed sheets, that is, the discharge/accommodation of stapled sheets, discharge/accommodation of folded sheets, discharge/accommodation of unprocessed sheets, and the sheet discharge mechanism are rather complicated.

Further, as disclosed in Japanese Patent Application Laid-open No. 11-11783, in the conventional sheet processing apparatus, the folded sheets stacked and accommodated on the tray are caused to fall onto sheets stacked on the tray for accommodation. Thus, it is necessary to arrange the discharge port and the sheet discharge route continuous therewith have to be arranged above the tray while forming a step, resulting in an increase in the size of the apparatus in the vertical direction. Thus, when arranging the tray unit in a limited space as in the case of the construction disclosed in Japanese Patent Application Laid-Open No. 2006-248686, there is involved a limitation in terms of space, and it is difficult to house the folding mechanism. Further, since the accommodation is effected through dropping, it is rather difficult to stack the sheets regularly on the tray.

Further, the folded sheets are accommodated such that their folded ends are directed forwardly in the discharging direction, with the discharge sheets being stacked on those sheets. Therefore, when the trailing ends of the stacked folded sheets are open (diverged), the leading ends in the discharging direction of the sheets to be discharged next are allowed to touch the trailing ends, which means there is a risk of the sheet attitude being disturbed. Further, in the case of the layout in which the tray is arranged above the folding route, the processing route, and then the tray are arranged successively in the sheet discharging direction, resulting in an increase in the size of the apparatus in the discharging direction and an increase in the installation space.

Further, as described above, in the construction disclosed in Japanese Patent Application Laid-Open No. H11-11783, the processing apparatus is arranged on the downstream side of the image forming apparatus so as to be adjacent thereto. This processing apparatus has a processing tray for first aligning and accumulating sheets, and a folding mechanism for folding the aligned sheet bundle in a bound state is arranged on the downstream side of this processing tray. Further, a tray unit for accommodating the sheets is arranged on the downstream side of the folding mechanism, and hence an increase in the size of the apparatus is involved.

Further, in the conventional apparatus, the sheet (bundle) folded by the folding mechanism is conveyed to the tray situated on the downstream side in the discharging direction, and hence the apparatus is rather large and requires a large installation space. In this way, conventionally, the folding mechanism is arranged on the downstream side of the processing tray for aligning the sheets, and the sheet bundle is conveyed from this folding mechanism to the tray situated on the downstream side in the discharging direction, and hence an increase in apparatus size is inevitable.

SUMMARY OF THE INVENTION

The present invention has been made in view of the various problems in the conventional sheet processing apparatuses. It is an object of the present invention to provide a sheet processing apparatus in which a reduction in system size is achieved and which is of a compact structure.

Further, in view of the various problems in the conventional sheet processing apparatuses, another object of the present invention is to provide a sheet processing apparatus which is generally reduced in size in the vertical direction and the sheet discharging direction and which allows sheets to be regularly stacked and accommodated on a stack tray.

Further, in view of the above-mentioned problems in the related art, still another object of the present invention is to provide a sheet processing apparatus which may be compactly formed in a small size and at low cost.

In order to solve the above-mentioned problems, the present invention provides a sheet processing apparatus comprising: a stack tray on which a sheet successively delivered from a delivery port is stacked, the stack tray including: a folding route receiving the sheet from the delivery port; a sheet folding device provided in the folding route to fold the sheet; and a sheet stacking surface for stacking the sheet, wherein the sheet processing apparatus is operable in selectively between a first mode in which a sheet from the delivery port is stacked on the sheet stacking surface of the stack tray, and a second mode in which a sheet folded by the sheet folding device is stacked on the same sheet stacking surface as in the first mode.

The sheet processing apparatus may further comprise a shift device for lifting and lowering the stack tray.

The shift device may move the stack tray to a first position so as to stack the sheet from the delivery port on the sheet stacking surface of the stack tray in the first mode, and the shift device may move the stack tray to a second position so that the folding route receives the sheet from the delivery port in the second mode.

The stack tray may have a tray housing which contains a binding device provided in the folding route so as to bind sheets and the sheet folding device for folding the bound sheets.

The tray housing may have the sheet stacking surface on the upper portion of the tray housing.

The sheet processing apparatus may further comprise a processing tray for delivering a sheet to the stack tray. The processing tray may have an alignment device for aligning sheets at a predetermined alignment position, and a sheet delivery device for delivering the aligned sheets to the stack tray.

The processing tray may have an end binding device for binding an end of the sheets aligned by the alignment device.

The sheet processing apparatus may further comprise another stack tray on which a sheet from the delivery port is stacked, wherein the shift device selectively may cause the sheet stacking surface of the stack tray, the folding route of the stack tray, and the another stack tray to face the delivery port.

The sheet processing apparatus may further comprise an abutment portion, wherein the shift device may press the sheet stacked on the sheet stacking surface against the abutment portion, to thereby sharpen a fold of the sheet stacked on the sheet stacking surface.

The sheet stacking surface may be arranged above the folding route, and in the second mode, the folded sheet may be discharged upwards from below the sheet stacking surface and stacked at the lowermost level of the sheet already stacked on the sheet stacking surface.

The stack tray may be provided with a sheet end regulating member for regulating an end of the sheet stacked on the sheet stacking surface, and the sheet end regulating member may regulate the end of the sheet according to the size of the sheet so that the sheet stacked on the sheet stacking surface overlaps with a discharge port leading from the folding route to the sheet stacking surface.

The stack tray may be provided with a movable lever member pushing up a trailing end of the folded sheet, and a lever drive device operating the movable lever member.

The movable lever member may discharge the sheet to a downstream side of the discharge port leading from the folding route to the sheet stacking surface, and the movable lever member may have a drive roller for discharging the sheet to be discharged in a direction in which the sheet is discharged to the sheet stacking surface.

The stack tray may be provided with a binding device arranged along the folding route so as to bind the central portion of a sheet.

The sheet folding device may have a pair of folding rollers in pressure contact with each other and arranged in a vicinity of a discharge port leading from the folding route to the sheet stacking surface, and a folding blade that bends the central portion of the bound sheet and inserts the central portion of the bound sheet between the pair of folding rollers.

One roller of the pair of folding rollers may comprise a revolving roller rolling on a peripheral surface of the other roller thereof. A pressure contact position of the revolving roller with the sheet may be moved on the peripheral surface of the other roller while the sheet is discharged onto the sheet stacking surface.

The revolving roller first may discharge a leading end of the sheet from the discharge port in a direction substantially orthogonal to the folding route, and then pushes out a trailing end of the sheet along the sheet stacking surface through movement of the pressure contact position with respect to the sheet.

The folding route may be formed as a substantially U-shaped route so that the folded sheet is discharged onto the sheet stacking surface of the stack tray such that a folded end of the sheet folded by the sheet folding device is directed to an upstream side with respect to a direction in which the sheet is delivered from the delivery port to the folding route.

The sheet stacking surface of the stack tray may be arranged above the folding route so as to be substantially parallel to the folding route.

The shift device may move the stack tray between to the first position and to the second position based on a sheet processing mode signal from outside.

Further, in order to solve the above-mentioned problems, the present invention provides an image forming apparatus comprising: an image forming portion for forming an image on a sheet; and the above mentioned sheet processing apparatus for processing the sheet delivered from the image forming portion.

The image forming apparatus may further comprise an original reading apparatus for reading an image of an original.

The sheet processing apparatus may be arranged above the image forming portion and below the original reading apparatus.

The sheet processing apparatus may receive the sheet from below and discharge a processed sheet between the image forming portion and the original reading apparatus.

The sheet processing apparatus may not be stuck out of a side surface of the image forming portion.

According to an embodiment of the present invention, when separately accommodating sheets, such as sheets, sheets to be subjected to processing such as binding or folding, interruption sheets, and overflow sheets (for interruption printing or the like) in multiple trays, it is possible to stack the sheets on the same stacking surface. As a result, it is possible to reduce the number of trays, and the tray unit as a whole may be formed in a small size and compact.

Further, in addition to the reduction in the number of trays, the tray unit containing the folding mechanism is formed thin and compact, whereby the apparatus may be selectively caused to face the delivery port of the image forming apparatus. Further, it is possible to form in a small size and at low cost a lifting/lowering mechanism for selectively causing multiple tray units formed in multiple vertical stages to face the sheet delivery port.

According to an embodiment of the present invention, it is possible to form a tray unit in which folded sheets are stacked and accommodated small and compact in the vertical direction of the apparatus, which vertical direction is perpendicular to the sheet delivering direction. That is, the sheet stacking surface accommodating folded sheets is provided above the folding route arranged in the sheet delivering direction, and the sheets are upwardly conveyed from below this stacking surface. Thus, it is possible to reduce the size and thickness of the apparatus as compared with the conventional structure in which the sheet delivery port is formed above the tray and in which the sheets are dropped for accommodation.

Further, the tray unit in which folded sheets are stacked and accommodated may be formed to be small and compact also in the sheet delivering direction. That is, the sheet stacking surface is arranged above the folding route arranged in the sheet delivering direction so as to accommodate the folded sheets substantially along a U-shaped configuration. Therefore, it is possible to reduce the space of the apparatus in the sheet delivering direction when compared with that in the conventional structure in which the folding route, and then the accommodating tray are arranged linearly in the delivering direction.

Further, the folded sheets accommodated on the stack tray may be accommodated in a regularly stacked state. The folded sheets are conveyed to the stack tray, starting with the folded ends, to reach under the lower layer of stacked sheets. Thus, paper folding or the like does not occur to the stacked sheets or the folded sheets getting under the lower layer thereof.

Further, a sheet end regulating stopper for positional regulation of the end edges in the conveying direction of folded sheets is provided on the stack tray, whereby the stacked sheets may be accommodated still more regularly without involving collapsing.

In an embodiment of the present invention, one of multiple stack trays comprises a folding route for folding a sheet bundle and a sheet stacking surface on which the folded sheet bundle is stacked. This folding route is formed into a substantially U-shaped route. The folded sheet bundle is discharged onto the sheet stacking surface such that the folded end of the folded sheet bundle is directed to the upstream side with respect to the direction in which the sheets are delivered from the processing tray on which the sheets are gathered. An embodiment of the present invention produces the following effects:

(1) Since the folding route and the sheet stacking surface are arranged so as to vertically overlap each other, it is possible to reduce the installation space.

(2) Further, the stack tray constructed as described above is arranged compact, with the sheet stacking surface and the folding route vertically overlapping each other. As a result, the mechanism for lifting and lowering the tray housing with respect to the delivery port of the processing tray may be formed simply at low cost.

Further according to an embodiment of the present invention, in the case in which the stack tray is arranged above the image forming portion and below the original reading apparatus, the tray does not externally protrude, thus helping to attain front loading.

Further features of the present invention become apparent from the following description of exemplary embodiments with reference to the accompanying drawings.

DESCRIPTION OF THE EMBODIMENTS

In the following, an embodiment of the present invention is described in detail with reference to the accompanying drawings.

Figure 1:
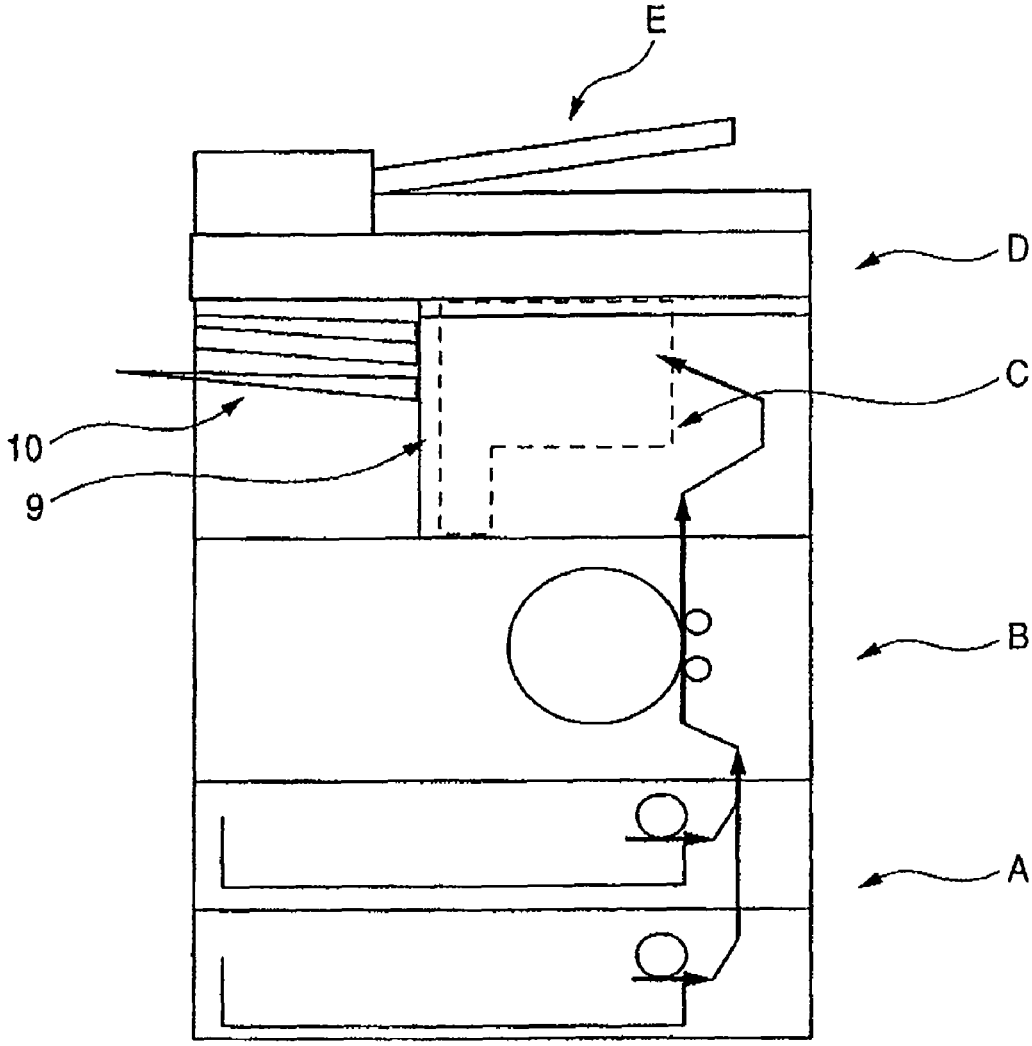
FIG. 1 is a general schematic view of an image forming system in which a sheet processing apparatus according to an embodiment of the present invention is mounted.
Figure 2:
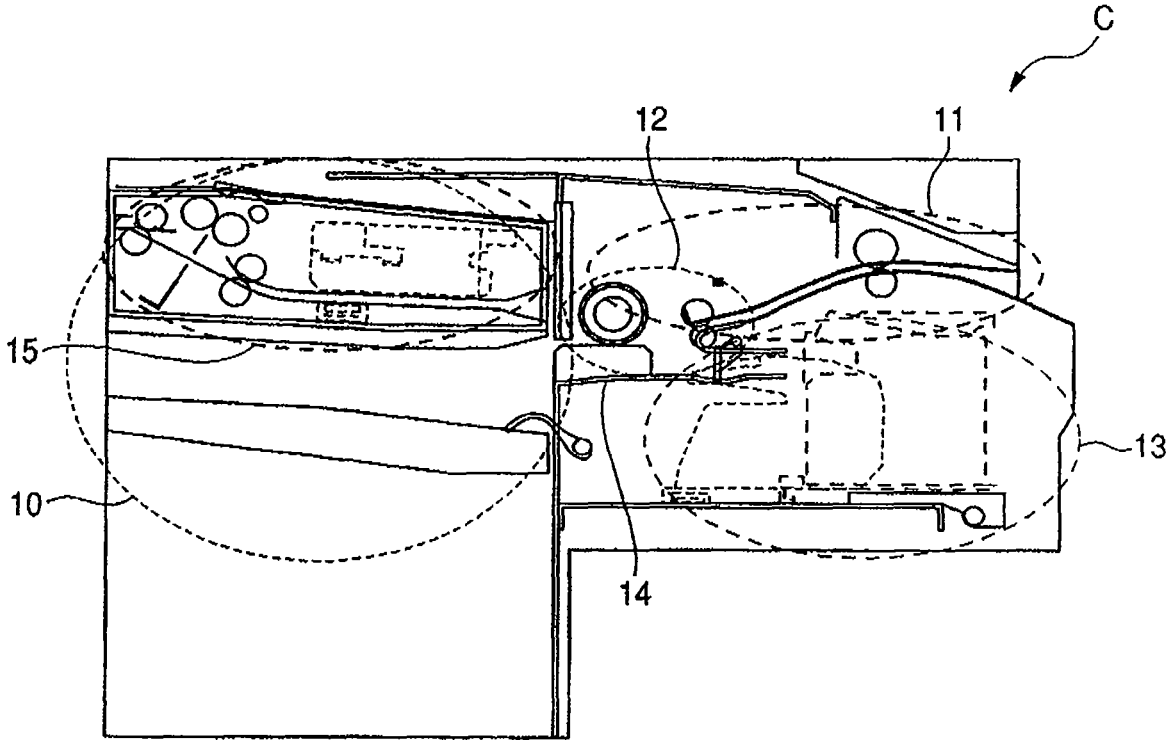
FIG. 2 is a schematic sectional view of a sheet processing apparatus according to an embodiment of the present invention.
Figure 3:
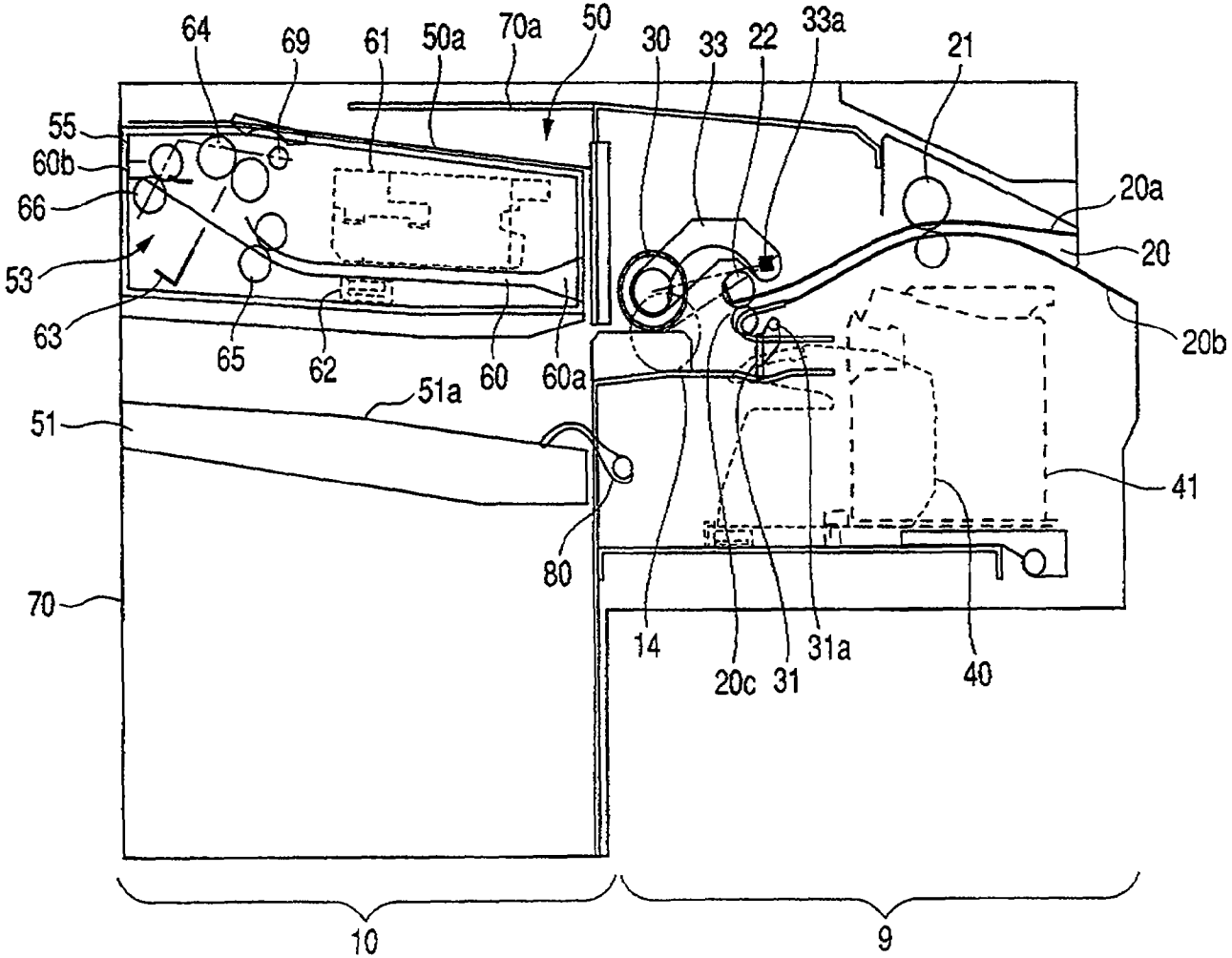
FIG. 3 is a detailed schematic sectional view of the sheet processing apparatus of FIG. 2.

FIG. 1 is a general schematic view of an image forming system in which a sheet processing apparatus according to an embodiment of the present invention is mounted, and FIGS. 2 and 3 are schematic sectional views of the sheet processing apparatus.

[Image Forming System]

As illustrated in FIG. 1, the image forming system includes a sheet feeding apparatus A, an image forming apparatus B, a sheet processing apparatus (hereinafter simply referred to as "processing apparatus") C, an original reading apparatus D, and an original conveying apparatus E.

The original conveying apparatus E conveys originals set on an original tray one by one onto a platen of the original reading apparatus D, and discharges them onto a discharge tray. In this process, the original reading apparatus D reads the originals passing the platen by the original conveying apparatus E by means of a reading unit. The reading unit includes a lamp, a plurality of mirrors, a lens, and an image sensor. Then, light emitted from the lamp of the reading unit is reflected by the original surface, and is guided to the image sensor by way of the plurality of mirrors and the lens, whereby an image is read by the image sensor. Image data on the original read by the image sensor undergoes a predetermined image processing before being transferred to an exposure control portion of the image forming apparatus B.

The exposure control portion of the image forming apparatus B outputs a laser beam in correspondence with an image signal. The laser beam is applied to a photosensitive drum while undergoing scanning by a polygon mirror. An electrostatic latent image in correspondence with the laser beam that has undergone scanning is formed on the photosensitive drum. The electrostatic latent image formed on the photosensitive drum is developed by a developing device, and is visualized as a toner image.

On the other hand, a sheet on which an image is to be formed it conveyed to a transfer portion of the image forming apparatus B from one of the cassettes of the sheet feeding apparatus A provided with a plurality of cassettes. Then, at the transfer portion, the toner image visualized is transferred to the sheet conveyed from the sheet feeding apparatus A to thereby effect image formation. After the transfer, the sheet undergoes fixing processing at a fixing portion. Then, the sheet that has passed the fixing portion is conveyed to the processing apparatus C.

The sheet conveyed to the processing apparatus C undergoes processing such as binding and folding at a processing portion 9 before being discharged to an accommodating portion 10.

[Processing Apparatus C]

Next, a sheet processing apparatus according to an embodiment of the present invention is described with reference to FIGS. 1, 2, and 3.

As illustrated in FIG. 1, the processing apparatus C of the present invention is arranged between the image forming apparatus B and the original reading apparatus D, and at one horizontal end thereof, there is provided the processing portion 9 having a binding device. Further, at the other end thereof, there is provided the accommodating portion 10 accommodating a sheet that has undergone processing. That is, in this image forming system, there is provided a so-called in-body delivery function by which the sheet discharged to the accommodating portion 10 is accommodated in a space between the image forming apparatus B and the original reading apparatus D.

FIG. 2 is a schematic sectional view illustrating each functional portion of the processing apparatus C. As illustrated in FIG. 2, the processing apparatus C includes a conveying portion 11 which receives a sheet from the image forming apparatus B and conveys the same, a processing tray 14 for processing the sheet conveyed by the conveying portion 11, an alignment portion 12 for aligning the sheets on the processing tray 14, a gripper/staple portion 13 for performing stapling on the aligned sheets, the accommodating portion 10 having a plurality of stack trays, and a saddle portion (sheet bundle folding portion) 15 provided on the lower surface side of one stack tray and adapted to perform stapling and folding on the sheets.

In the following, the functional portions of the processing apparatus C are described in detail with reference to FIG. 3.

(Conveying Portion 11)

The conveying portion 11 is provided with a conveying route 20 communicating with the delivery port of the image forming apparatus B, and a conveying roller pair 21 conveying a sheet along the conveying route 20. Further, at a carrying-out port 20*c* of the conveying route 20, there is provided a delivery roller pair 22, and the delivery roller pair 22 successively delivers sheets to a processing tray 14 arranged below the conveying route 20. The conveying route 20 is formed by a pair of guide plates 20*a* and 20*b* for guiding sheets.

In this embodiment, the sheet delivered by the delivery roller pair 22 is placed in a state in which the sheet bestrides over sheet stacking surfaces of the processing tray 14 and a stack tray described below or a folding route, and undergoes a predetermined processing.

(Alignment Portion 12)

The alignment portion 12 is provided with a stopper member 31 for aligning one end of the sheet delivered onto the processing tray 14, a shift roller 30 which is capable of forward and reverse rotation and which comes into contact with the upper surface of the sheet delivered onto the processing tray 14 and sends the sheet delivered from the delivery roller pair 22 in the delivery direction and a direction different from the delivery direction, and an alignment member 32 (see FIG. 5) abutting the end in the sheet width direction (direction perpendicular to the sheet delivery direction) of the sheet on the processing tray 14.

The stopper member 31 is rotatable around a support shaft 31*a*, and may move to an alignment position where it is upright and to a retracted position where it is in a substantially horizontal state. The shift roller 30 is provided at one end of an arm member 33 provided so as to be rotatable around a support shaft 33*a* of a polygonal sectional configuration, and may move through rotating motion of the arm member 33 to a contact position where it is in contact with the upper surface of the sheet on the processing tray 14 and a retracted position where it is retracted from the upper surface the sheet. Further, the arm member 33 is movable in the sheet width direction along the support shaft 33*a*, through movement of the arm member 33, the shift roller 30 as the alignment device slides in the sheet width direction.

Further, when the leading end of the sheet is delivered onto the processing tray 14, the shift roller 30 moves from the retracted position to the contact position before the trailing end of the sheet has left the delivery roller pair 22. Further, the shift roller 30 rotates to convey the sheet until the trailing end of the sheet is discharged onto the processing tray 14. In this process, that is, during rotation (forward rotation) of the shift roller 30 in the sheet conveying direction, a gripper unit 40 described below holds the preceding sheet or the preceding sheet bundle so that the preceding sheet or the preceding sheet bundle stacked on the processing tray 14 may not be fed therewith. When the trailing end of the sheet is discharged onto the processing tray 14, the rotation of the shift roller 30 is stopped. After that, the gripper unit 40 cancels the above-mentioned holding, and the shift roller 30 continues reverse rotation, sending the sheet discharged onto the processing tray 14 in a direction opposite to the delivery direction, that is, toward the stopper member 31. The sheet sent by the shift roller 30 abuts the stopper member 31 at the alignment position, and the end thereof in the feeding direction is aligned. When the end in the feeding direction of the sheet is aligned, the rotation of the shift roller 30 is stopped, and the shift roller 30 is caused to slide toward the alignment member 32 while in contact with the upper surface of the sheet. The outer peripheral surface of the shift roller 30 is formed of a high friction material such as urethane rubber, and hence the sheet also slides toward the alignment member 32 in association with the sliding movement of the shift roller 30. Then, the shift roller 30 slides until one end in the width direction of the sheet abuts the alignment member 32 before stopping. As a result, the end in the width direction of the sheet is aligned. When the sheet alignment operation is completed, the arm member 33 rotates upwardly, and the shift roller 30 moves to the retracted position spaced apart from the upper surface of the sheet. At this time, in order that the sheets or the preceding sheet bundle stacked and aligned on the processing tray 14 may not move, the gripper unit 40 holds the preceding sheets or the preceding sheet bundle. Then, the arm member 33 and the shift roller 30 slide in the sheet width direction along the support shaft 33*a* to the initial position substantially at the center of the processing tray 14. When the next sheet is delivered onto the processing tray 14, a similar alignment operation is executed. The arm member 33 and the shift roller 30 form the alignment device.

(Gripper/Staple Portion 13)

Figure 4A:
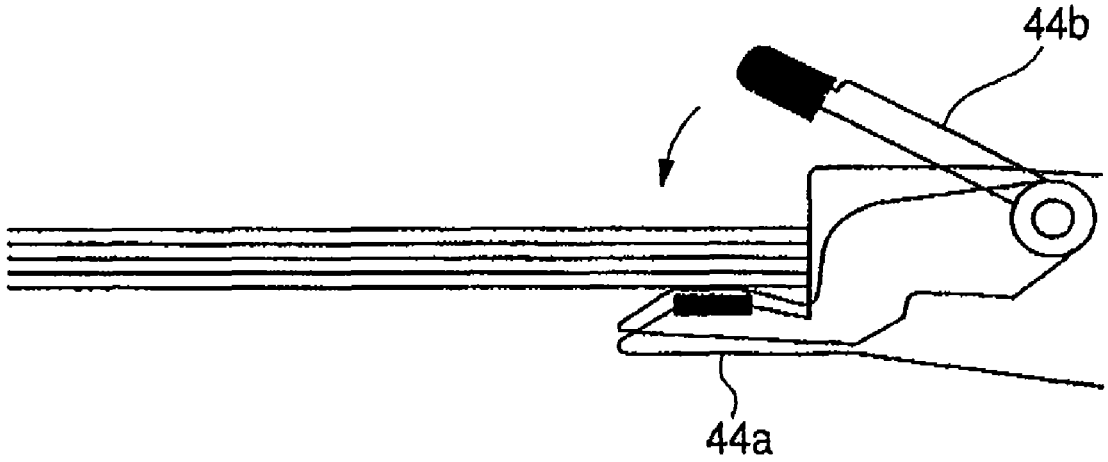
FIGS. 4A and 4B are schematic views illustrating how a gripper unit holds a sheet bundle in the sheet processing apparatus of FIG. 2.
Figure 4B:
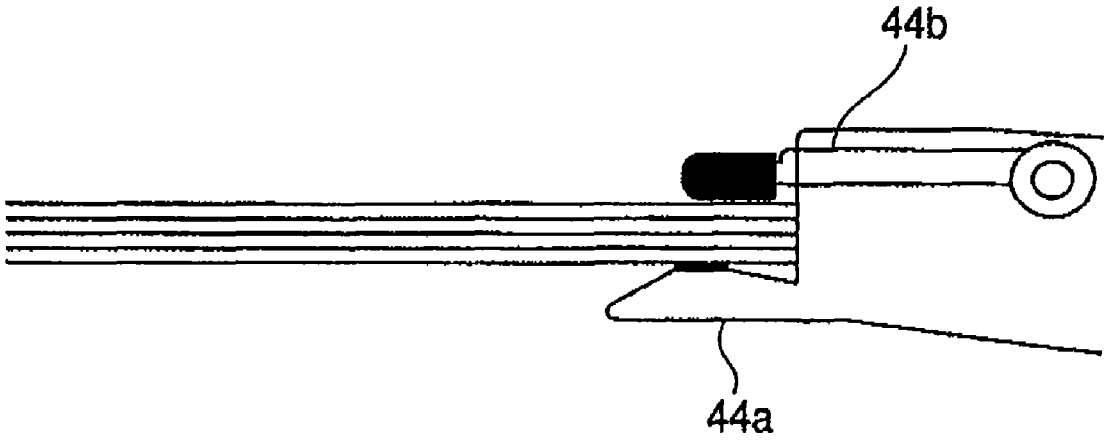
Figure 5:
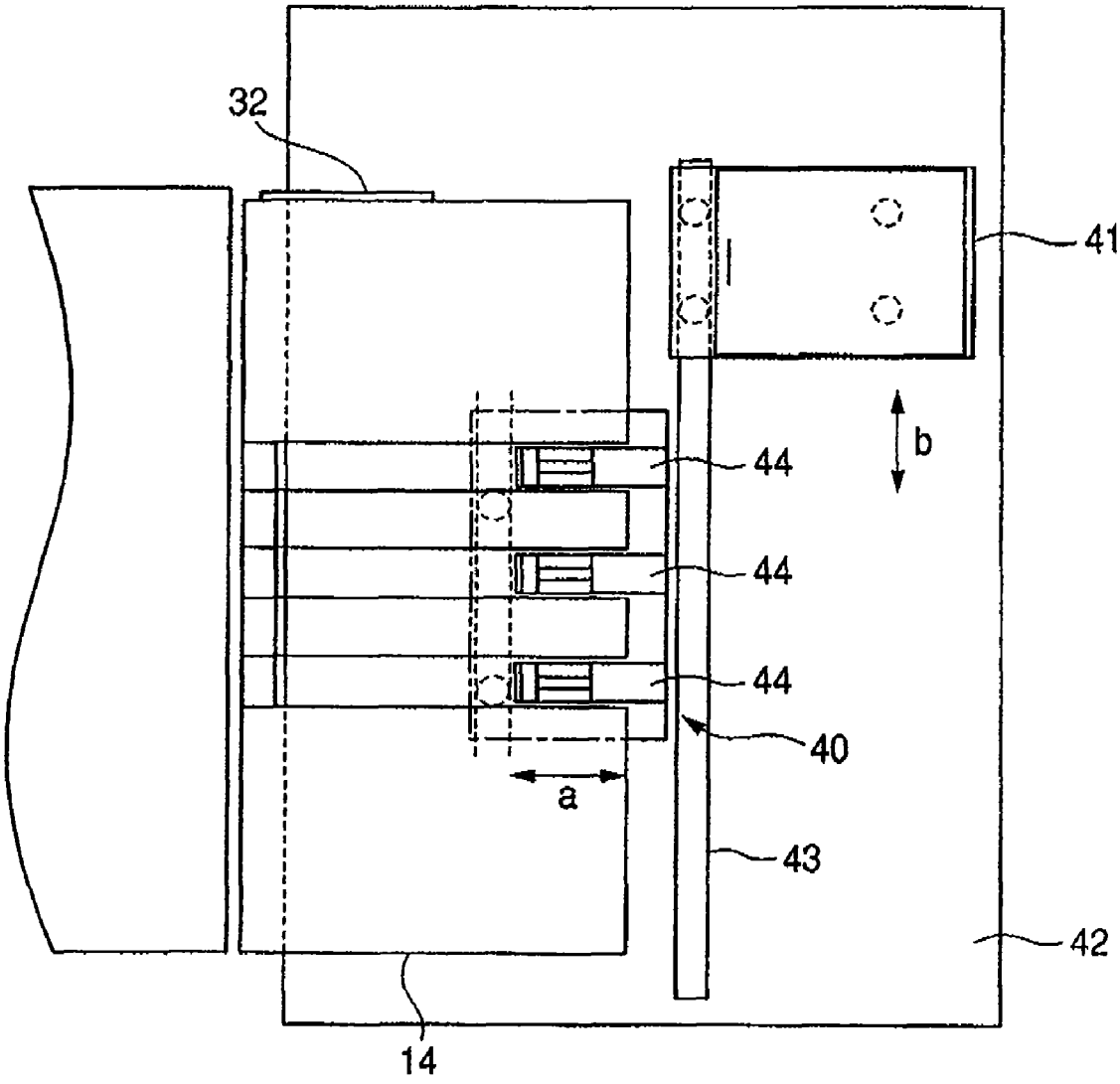
FIG. 5 is a plan view illustrating the construction of a gripper/staple portion of the sheet processing apparatus of FIG. 2.

Next, the gripper/staple portion 13 is described. FIGS. 4A and 4B are schematic diagrams illustrating how the gripper unit 40 thereof holds a sheet bundle, and FIG. 5 is a plan view illustrating the construction of the gripper/staple portion. As illustrated in those drawings, the gripper/staple portion 13 is provided with the gripper unit 40 for gripping and moving the sheet bundle aligned on the processing tray 14, and a staple unit 41 for binding the sheet bundle moved to the stapling position by the gripper unit 40.

The gripper unit 40 is provided with a pair of grip arms 44 (44*a* and 44*b*) for gripping the sheet bundle aligned on the processing tray 14. As illustrated in FIGS. 4A and 4B, the pair of grip arms 44 include a stationary grip arm 44*a* supporting the lower surface of the sheet bundle, and a movable grip arm 44*b* opposed to the stationary grip arm 44*a* and adapted to pressurize the upper surface of the sheet bundle. Further, the gripper unit 40 is movable in the sheet feeding direction (indicated by an arrow "a" of FIG. 5), and may grasp the sheet bundle by the grip arm pair 44 and move it to the stapling position. As illustrated in FIG. 5, in the gripper unit 40 of this embodiment, there are provided three grip arm pairs 44, and the three grip arm pairs 44 are arranged at positions spaced apart from each other by a predetermined distance in the sheet width direction.

A staple head and an anvil block are incorporated into the staple unit 41, an a needle-like stale is bent into a U-shape (a shape of a square bracket) and forced into the sheet bundle, with the forward ends thereof being bent at the anvil block to thereby bind the sheet bundle. In this embodiment, there is adopted a generally used staple unit in which the staple head is mounted to one of upper and lower lever members whose proximal ends are rotatably supported, and in which the anvil block is mounted to the other, with the upper and lower lever members being caused to reciprocate between a separated position and a pressure contact position by a drive cam member.

As illustrated in FIG. 5, on a base stand 42 at the bottom of the processing apparatus C, there is provided a guide rail 43 for moving the staple unit 41 in the sheet width direction (indicated by an arrow "b" in FIG. 5). The guide rail 43 is formed longer than the maximum sheet width, and may bind both ends of sheets.

With the above-mentioned construction, after the sheet bundle aligned on the processing tray 14 is gripped by the grip arm pair 44 of the gripper unit 40, the gripper unit 40 moves in the sheet feeding direction, thus moving the sheet bundle to the stapling position. At this time, the stopper member 31 has moved to the retracted position where it does not hinder the movement of the sheet bundle by the gripper unit 40.

Further, binding process is performed by the staple unit 41 on an end of the sheet bundle moved to the stapling position by the gripper unit 40. As the binding process, it is possible to perform a corner binding process in which binding process is performed on one side of the sheet bundle and a two-point side binding process in which binding process is performed on two predetermined positions at the end in the sheet conveying direction. The staple unit 41 moves along the guide rail 43, and executes one of corner binding process and two-point side binding process. The staple unit 41 constitutes an end binding device for binding an end of the aligned sheet bundle.

The sheet bundle that has undergone binding process is gripped again by the grip arm pair 44 of the gripper unit 40. Then, while gripping the sheet bundle by the grip arm pair 44, the gripper unit 40 moves in a direction different from the above-mentioned sheet feeding direction, that is, toward the accommodating portion 10. As a result, the sheet bundle moves so as to be pushed out toward the accommodating portion 10. When the sheet bundle is moved to the accommodating portion 10, the gripper unit 40 releases the gripping of the sheet bundle performed by the grip arm pair 44, and moves to an intermediate position between the stopper member 31 and the stapling position, where it is kept on standby until the processing of the next sheet bundle. The gripper unit 40 constitutes a sheet delivery device for conveying the aligned sheet bundle to the stack tray.

(Accommodating Portion 10 and Saddle Portion 15)

Next, the accommodating portion 10 is described with reference to FIG. 3. Multiple stack trays are arranged in the accommodating portion 10 on the downstream side of the processing tray 14. In this embodiment, the multiple stack trays consist of a first stack tray 50 and a second stack tray 51, which may be selectively connected to the processing tray 14.

The first stack tray 50 is provided with a sheet stacking surface 50*a* for stacking and accommodating folded sheets. The second stack tray 51 is formed by a tray member having a sheet stacking surface 51*a* connectable to the processing tray 14.

The first stack tray 50 is provided with a saddle unit (sheet bundle folding unit) 53. The processing tray 14 accumulates the sheets and gathers the sheets into a sheet bundle. The sheet bundle is bound in a folding route 60. The saddle unit 53 folds the bound sheet bundle and accommodates the folded sheet bundle on the sheet stacking surface 50*a* of the first stack tray 50.

That is, on the first stack tray 50, there are accommodated the folded sheet bundle from the saddle unit 53 for performing binding process and folding process on sheet bundles, and the sheet bundle that has undergone corner binding process or two-point side binding process at the staple unit 41. The second stack tray 51 mainly accommodates a sheet bundle that has undergone corner binding process or two-point side binding process at the staple unit 41. Of course, it is also possible for the two stack trays to accommodate a sheet bundle that has undergone neither binding nor folding.

(Lifting and Lowering of the Stack Trays)

The first and second stack trays 50 and 51 are supported by the frame of the processing apparatus C adjacent to the processing tray 14 so as to be capable of vertically lifting and lowering independently.

Figure 6A:
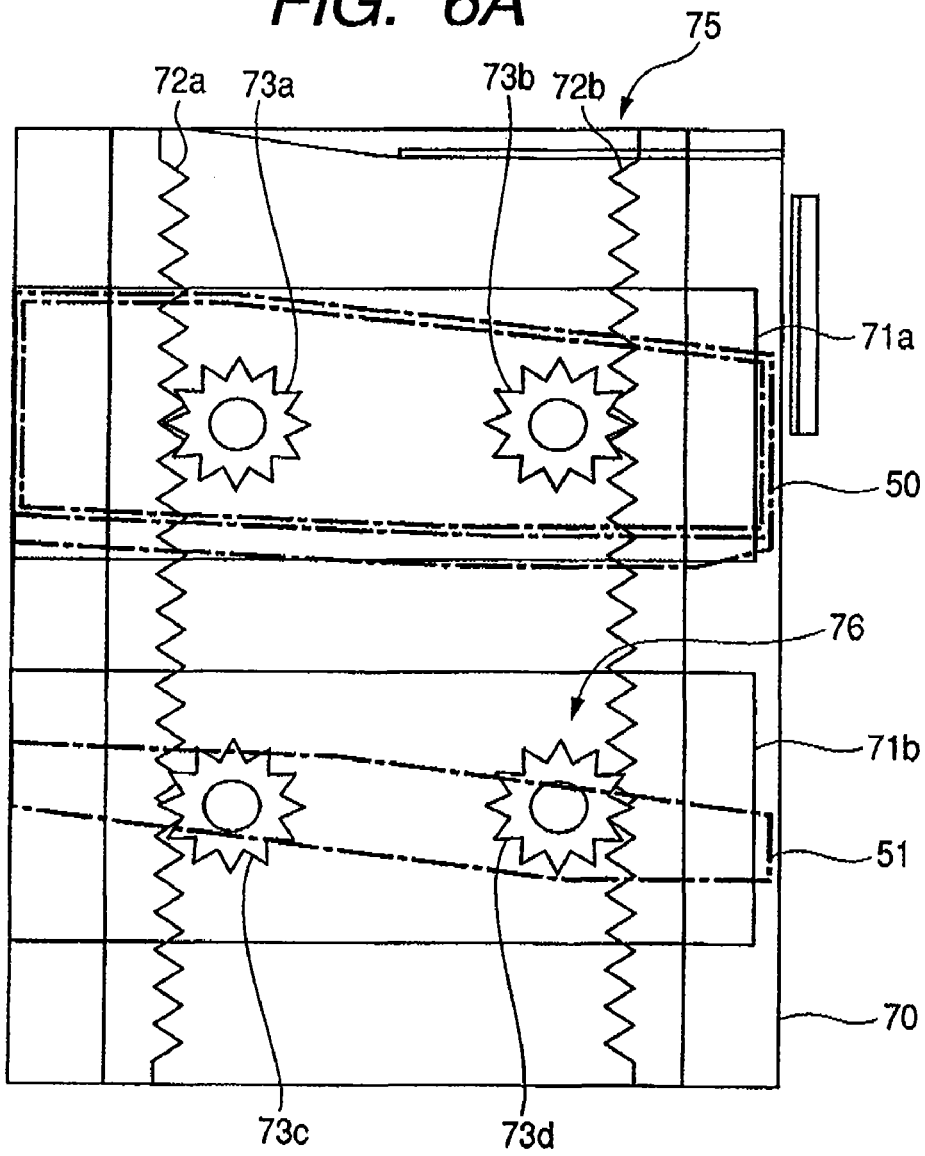
FIGS. 6A and 6B are schematic views of a stack tray lifting/lowering mechanism of the sheet processing apparatus of FIG. 2.
Figure 6B:
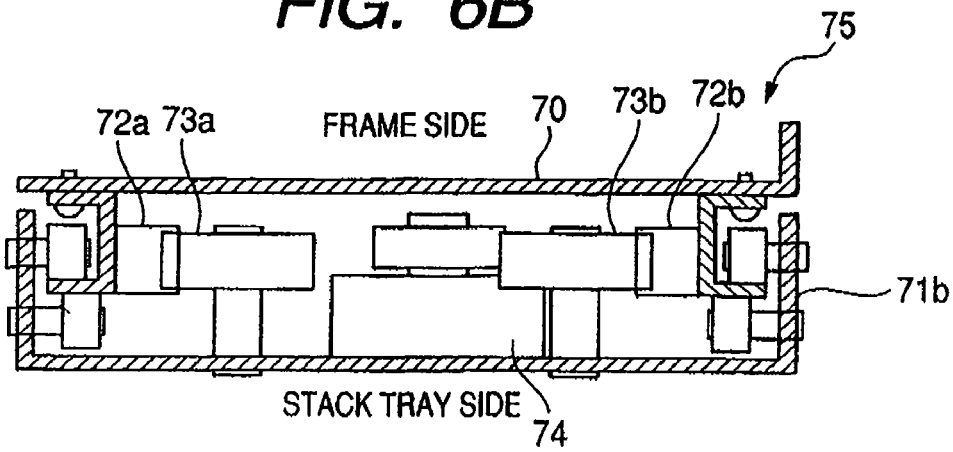

FIGS. 6A and 6B are schematic views illustrating, e.g., lifting/lowering mechanisms 75 and 76 as shift devices for moving the stack trays up and down. FIG. 6A is a longitudinal sectional view thereof, and FIG. 6B is a partial plan view thereof. The first stack tray 50 containing the saddle unit 53 and the second stack tray 51 are respectively mounting to first and second support plates 71*a* and 71*b*.

The first stack tray 50 and the second stack tray 51 constitute a tray unit.

Two pinions 73*a* and 73*b* are mounted to the surface of the first support plate 71*a* on the side opposite to the surface to which the first stack tray 50 is mounted. The two pinions 73*a* and 73*b* are respectively in mesh with racks 72*a* and 72*b* arranged so as to be horizontally spaced apart from each other. Further, by rotating one of the pinions 73*a* and 73*b* by a motor 74, the support plat 71*a* moves along the racks 72*a* and 72*b*, and, with this movement, the first stack tray 50 is lifted/lowered. The lifting/lowering mechanism 75 for the first stack tray 50 includes the racks 72*a* and 72*b* and the pinions 73*a* and 73*b*.

The lifting/lowering mechanism 76 for the second stack tray 51 has a construction similar to that of the lifting/lowering mechanism 75 for the first stack tray 50. That is, two pinions 73*c* and 73*d* on the surface on the side opposite to the surface of the second support plate 71*b* supporting the second stack tray 51 are respectively in mesh with the racks 72*a* and 72*b*, and, by rotating one of the pinions 73*c* and 73*d*, the second stack tray 51 is lifted/lowered. The lifting/lowering mechanism 76 for the second stack tray 51 includes the racks 72*a* and 72*b* and the pinions 73*c* and 73*d*.

The racks 72*a* and 72*b* are mounted to a tray frame 70 provided inside the accommodating portion 10.

Figure 7A:
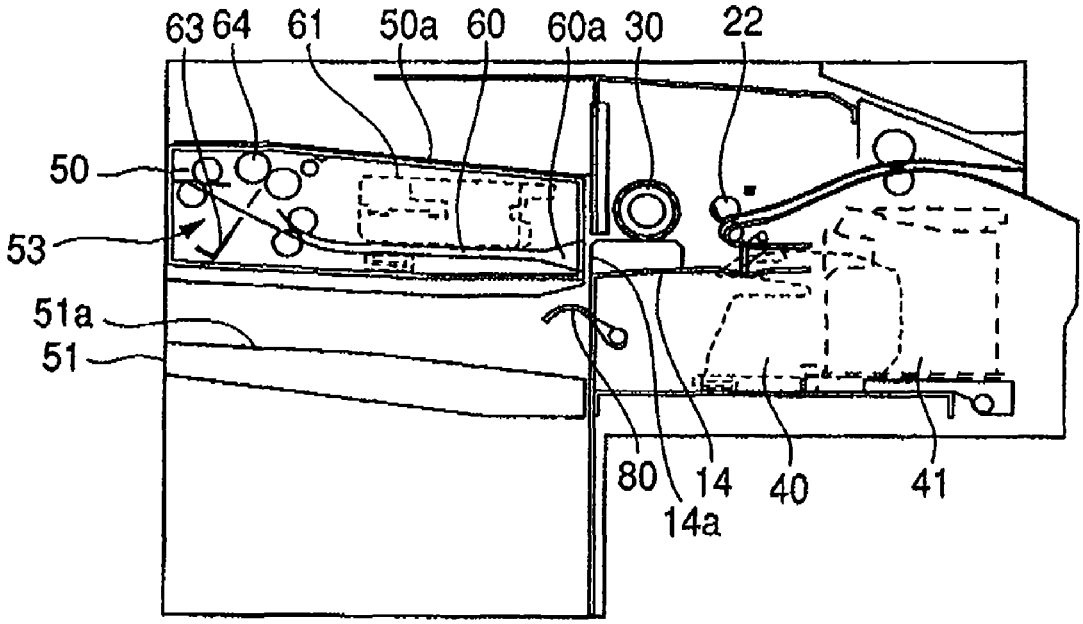
FIGS. 7A, 7B, and 7C are schematic views illustrating the stack tray lifting/lowering positions of the sheet processing apparatus of FIG. 2.
Figure 7B:
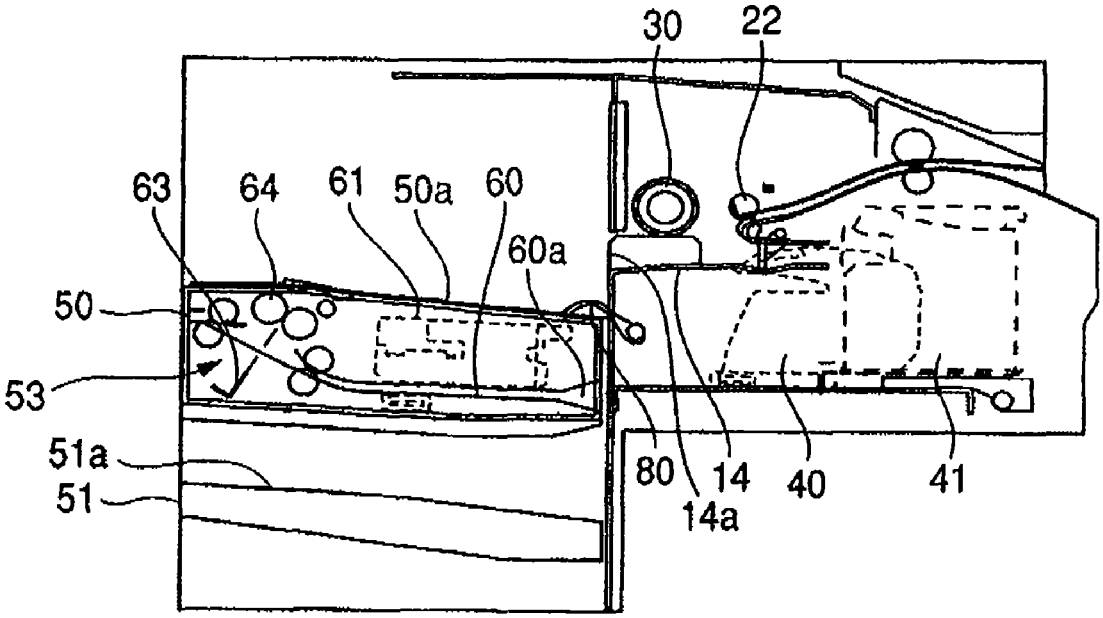
Figure 7C:
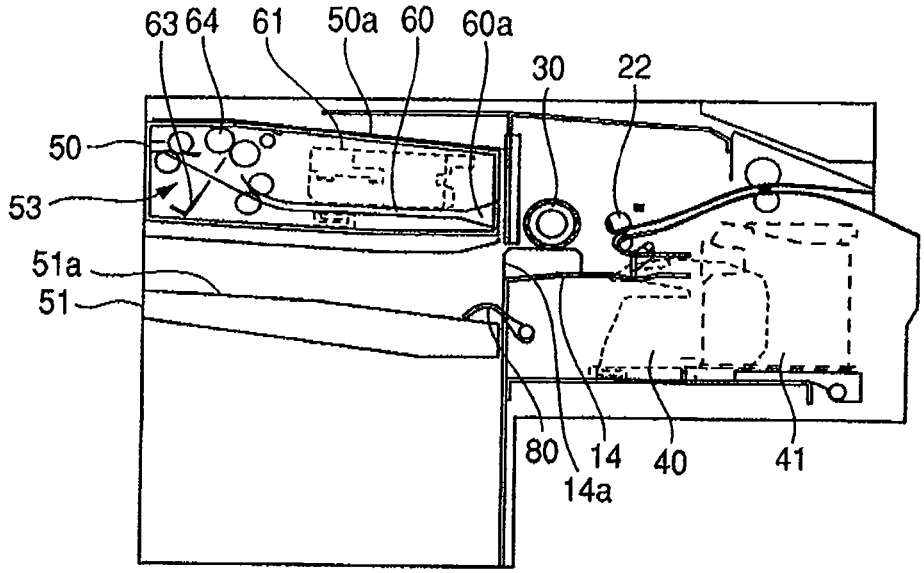

FIGS. 7A, 7B, and 7C are diagrams for illustrating the lifting/lowering positions of the stack trays of the processing apparatus C. In FIG. 7A, the first stack tray 50 is moved to a position (second position) where the sheet delivered from the processing tray 14 may be received from a sheet inlet 60*a* of the first stack tray 50. That is, the lifting/lowering mechanism 75 causes the sheet inlet 60*a* of the first stack tray 50 to face the sheet delivery port 14*a* of the processing tray 14. In FIG. 7B, the first stack tray 50 is moved to a position (first position) where the sheet delivered from the processing tray 14 may be directly received by the sheet stacking surface 50*a* of the first stack tray 50. That is, the lifting/lowering mechanism 75 causes the sheet stacking surface 50*a* of the first stack tray 50 to face the delivery port 14*a* of the processing tray 14. In FIG. 7C, the second stack tray 51 is moved to a position where the sheet delivered from the processing tray 14 may be received by the sheet stacking surface 51*a* of the second stack tray 51. That is, the lifting/lowering mechanism 76 causes the sheet stacking surface 51*a* of the second stack tray 51 to face the delivery port 14*a* of the processing tray 14. On the basis of a sheet processing mode signal from the outside, the lifting/lowering mechanisms 75 and 76 cause those stack trays to move up and down.

(First Stack Tray 50)

Next, the construction of the first stack tray 50 and the saddle unit 53 is described in detail.

As illustrated in FIG. 3, the saddle unit 53 has the folding route 60, which has, for example, a staple head unit 61 and an anvil unit 62 as a saddle binding device for binding the center (fold position) of the sheet bundle. Further, a folding blade 63 and a pair of folding rollers 64 are provided on the downstream side of the staple head unit 61. That is, the first stack tray 50 has on its upper surface the sheet stacking surface 50*a* formed by resin molding or the like, and has, at the bottom portion thereof, a space containing as a unit the folding route 60, the staple head unit 61, the anvil unit 62, and further, the sheet folding device, for example, the folding blade 63 and the pair of folding rollers 64. Due to this construction, the user is prevented from touching from outside the staple head unit 61, the anvil unit 62, the folding blade 63, and the folding roller 64 which are provide in the inside. That is, the first stack tray 50 has a tray housing 55. The tray housing 55 contains the binding devices (61, 62) and the sheet folding devices (63, 64), with the sheet stacking surface 50*a* being provided on the upper portion of the tray housing 55.

As described above, the first stack tray 50 is formed so as to be capable of lifting and lowering within the accommodating portion 10. Thus, it is possible to move the first stack tray 50 to the position (second position) where the sheet delivered from the processing tray 14 is received by the sheet inlet 60*a* of the saddle unit 53 (FIG. 7A), and to the position (first position) where the sheet delivered from the processing tray 14 is directly received by the sheet stacking surface 50*a* (FIG. 7B) in accordance with the processing to be performed on the sheet.

As illustrated in FIG. 7B, the processing apparatus C is operable in a first mode in which the sheet bundle from the processing tray 14 is directly stacked on the sheet stacking surface 50*a* of the first stack tray 50.

Further, as illustrated in FIG. 7A, the processing apparatus C is operable in a second mode in which the sheet bundle folded by the saddle unit 53 is stacked on the same stacking surface 50*a* as in the first mode.

Further, as illustrated in FIG. 7C, the processing apparatus C is operable in a third mode in which the sheet bundle from the processing tray 14 is stacked on the sheet stacking surface 51*a* of the second stack tray 51.

The processing apparatus C is operable in selectively among the first mode, the second mode, and the third mode. For example, the user may select the first mode, the second mode, or the third mode by means of an operation panel (not shown) of the image forming system.

Further, at each interval of stacking of the sheet bundle (e.g., each time a fixed number of bundles are stacked) folded by the sheet folding device (e.g., the folding blade 63 and the pair of folding rollers 64) on the sheet stacking surface 50*a*, the first stack tray 50 is lifted by the lifting/lowering mechanism 75 to press the sheet bundle on the sheet stacking surface 50*a*, for example, against a top plate 70*a* of a tray frame 70 (see FIG. 3) serving as an abutment portion for restricting the raising of the stack tray. In this way, the sheets are held between the sheet stacking surface 50*a* and the top plate 70*a* of the tray frame 70, whereby the folded portion of the folded sheet bundle stacked on the sheet stacking surface 50*a* is further folded strongly, thereby preventing divergence of the fold.

(Saddle-Binding/Saddle-Folding Portion)

Inside the folding route 60, there are arranged the staple head unit 61 and the anvil unit 62, a folding conveying roller pair 65, the folding blade (folding knife) 63, and a folding conveying runner pair 66 in order of mention from the inlet 60*a* side. Further, a pair of folding rollers 64 is arranged at a position opposed to the folding blade 63, with the sheets being interposed therebetween.

The staple head unit 61, which inserts a staple into the sheet bundle introduced into the folding route 60, includes a former member for bending a staple (blank) accommodated in a staple cartridge into a U-shape (a shape of a square bracket), a driver member for inserting the staple into the sheets, and a drive cam and a drive motor for operating the driver member. The staple head unit 61 is supported so as to be movable in the sheet width direction, and is adapted to bind the sheet bundle at two positions (multiple positions) in the sheet width direction.

On the other hand, the anvil unit 62 for bending the distal ends of the staple is formed by a stay member having a bending groove for bending staple ends. In particular, the device illustrated in FIG. 3 is provided with multiple bending grooves in the sheet width direction. The multiple bending grooves are formed so as to effect binding on multiple positions set in advance in cooperation with the staple head unit 61.

The folding blade 63 is arranged at a position between the folding conveying roller pair 65 and the folding conveying runner pair 66 so as to fold, for example, from the center, the sheet bundle that has undergone binding process (saddle binding process) substantially at the center of the sheets (saddle binding) in the shape of a booklet. Further, the folding blade 63 is supported so as to be capable of reciprocation to insert the sheet bundle into the nip position of the pair of folding rollers 64 from a direction perpendicular to the sheet bundle (see FIGS. 9A, 9B, and 9C).

Figure 8:
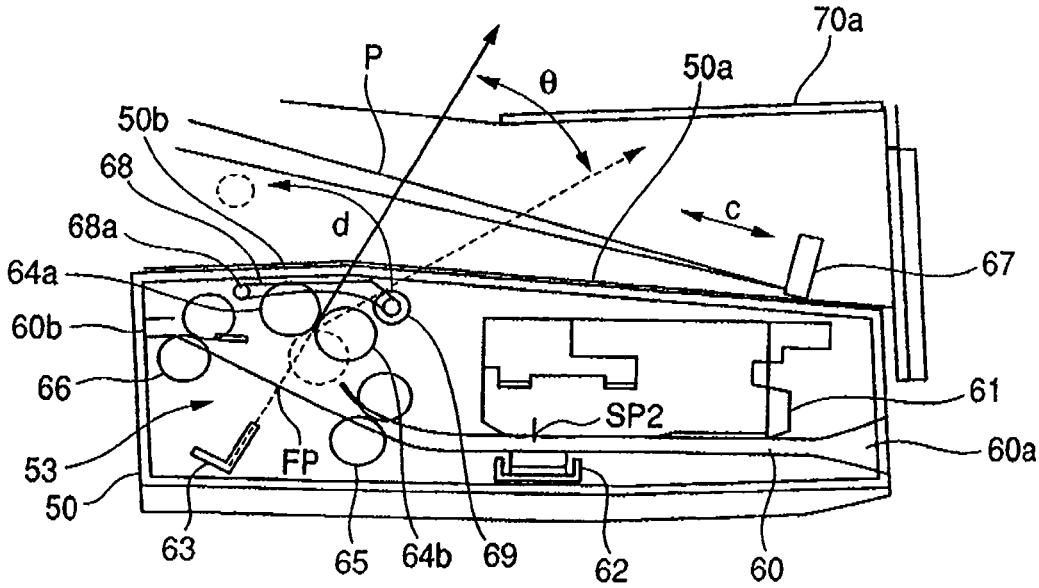
FIG. 8 is a schematic view illustrating the construction and operation of a saddle unit of the sheet processing apparatus of FIG. 2.

The pair of folding rollers 64 are arranged so as to be in pressure contact with each other at a position opposed to the folding blade 63, with the sheet bundle being interposed therebetween. Further, one folding roller 64*a* of the pair of folding rollers 64 is connected to a drive motor, and the other folding roller 64*b* is formed so as to follow the one folding roller 64*a* (see FIG. 8). Further, as illustrated in FIG. 8, in this embodiment, the other folding roller 64*b* revolves with respect to the one folding roller 64*a*, resulting in deflection of the pressure contact direction. That is, the other folding roller 64*b* revolves clockwise as seen in FIG. 8 from a first position where it corresponds to the direction of sheet insertion by the folding blade 63 (position of the other folding roller 64*b* indicated by solid line in FIG. 8) to a second position for delivering the sheets along the sheet stacking surface 50*a* (position of the other folding roller 64*b* indicated by dashed line in FIG. 8). As a result, as illustrated in FIG. 8, the direction in which the folded sheet bundle is discharged is deflected by an angle θ, and the folded sheet bundle is smoothly discharged between the preceding sheet bundle and the sheet stacking surface 50*a*.

Figure 11A:
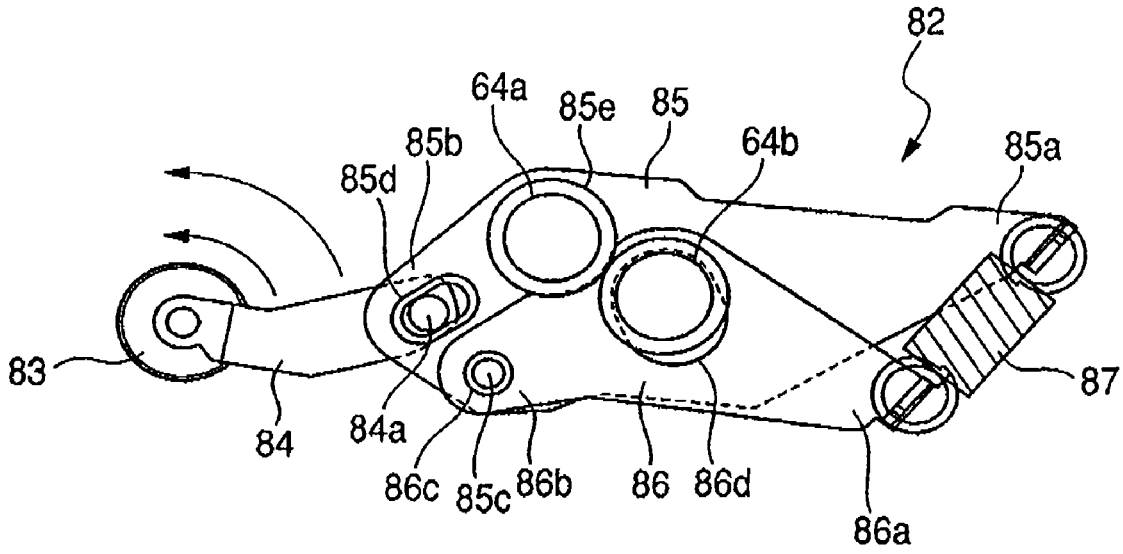
FIG. 11A is a diagram illustrating a folding roller revolving mechanism in a first position.
Figure 11B:
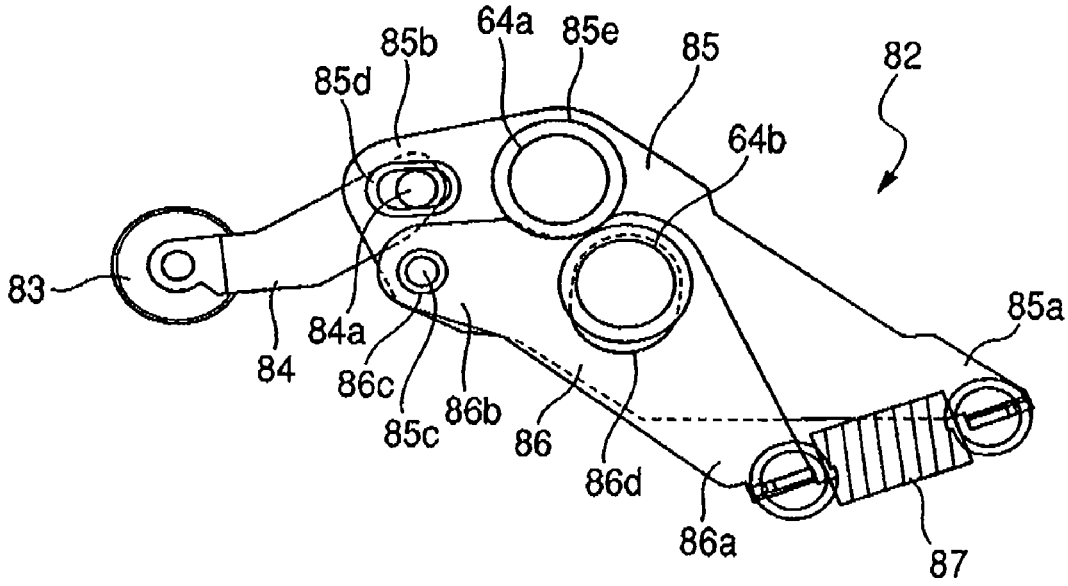
FIG. 11B is a diagram illustrating the folding roller revolving mechanism in a second position

A folding roller revolving mechanism will be described. FIG. 11A is a diagram illustrating the folding roller revolving mechanism in a first position. FIG. 11B is a diagram illustrating the folding roller revolving mechanism in a second position. The folding roller revolving mechanism 82 includes a rotating drive shaft 83, an arm 84 rotating together with the drive shaft 83 around the drive shaft 83, a first plate member 85 rotating around the one folding roller 64*a*, a second plate member 86 rotating around a pin 85*c* provided on the first plate member 85, and a tension spring 87 connected between one end 85*a* of the first plate member 85 and one end 86*a* of the second plate member 86.

A pin 84*a* is provided at the distal end of the arm 84. The pin 84*a* is inserted into an elongated hole 85*d* provided in the other end 85*b* of the first plate member 85. The pin 84*a* is slidable within the elongated hole 85*a*. A hole 85*e* of the first plate member 85 is fitted onto the shaft of the one folding roller 64*a*. The first plate member 85 is rotatable around the one folding roller 64*a*. At the other end 86*b* of the second plate member 86, there is provided a hole 86*c* to be fitted onto the pin 85*c* of the first plate member 85. The second plate member 86 is provided with a hole 86*d* to be engaged with the shaft of the other folding roller 64*b*. The tension spring 87 urges one end 86*a* of the second plate member, thereby generating folding pressure between the folding roller 64*a* and 64*b*.

In the folding roller revolving mechanism 82 in the first position illustrated in FIG. 11A, when the drive shaft 83 rotates counterclockwise, the arm 84 rotates counterclockwise together with the drive shaft 83. While the pin 84*a* of the arm 84 sliding within the elongated hole 85*d* of the first plate member 85, the arm 84 rotates the first plate member 85 clockwise around the one folding roller 64*a*. The hole 86*c* of the second plate member 86 is engaged with the pin 85*c* of the first plate member 85, and hence the second plate member 86 rotates clockwise together with the first plate member 85. The hole 86*d* of the second plate member 86 is engaged with the shaft of the other folding roller 64*b*, and hence, due to the clockwise rotation of the second plate member 86, the other folding roller 64*b* revolves clockwise around the one folding roller 64*a* while rolling on the peripheral surface of the one folding roller 64*a*. As a result, the folding roller revolving mechanism 82 assumes the second position illustrated in FIG. 11B.

In the second position illustrated in FIG. 11B, when the arm 84 rotates clockwise through clockwise rotation of the drive shaft 83, the folding roller revolving mechanism 82 moves from the second position to the first position illustrated in FIG. 11A.

A sheet overrun opening 60*b* illustrated in FIG. 8 temporarily guides the leading end of the sheet conveyed from the folding route 60 to the exterior of the saddle unit 53. The folding route 60 is constructed such that the sheet is supported (bridge-supported) astride both the processing tray 14 and the folding route 60 in a state in which the folding route 60 is connected to the processing tray 14. Due to this construction, the processing tray 14 may be formed to be short and compact with respect to the sheet length, and, at same time, it is possible to convey the sheet bundle to the saddle binding position SP2 (see FIG. 8) in the folding route 60 while holding the sheet bundle by the gripper unit 40.

Further, the first stack tray 50 has a discharge port 50*b* for discharging the sheet onto the sheet stacking surface 50*a* from the pair of folding rollers 64.

(Saddle Portion 15)

Next, it is described how, in the first stack tray 50, the sheet folded by the folding blade 63 (folded sheet) is delivered from the discharge port 50*b*.

The folded sheet, which reaches the sheet stacking surface 50*a* from the folding route 60 by way of the discharge port 50*b*, is delivered upwards from below through a substantially U-shaped path. The sheet stacking surface 50*a* is arranged above the folding route 60, and the conveying direction of the sheet folded in the folding route 60 is reversed at the saddle unit 53.

That is, in FIG. 2, the sheet is conveyed to the left from the processing tray 14, and, at the discharge port 50*b*, the conveying direction of the folded sheet is reversed to the right as seen in FIG. 2. This state is described with reference to FIG. 8.

First, as illustrated in FIG. 8, a discharged sheet stopper 67 for regulating the position of the leading end (folded end) of the folded sheet is arranged on the sheet stacking surface 50*a*. The discharged sheet stopper 67 serves as a sheet end regulating member for regulating the leading end (folded end) of the folded sheet in accordance with the sheet size. The position of the discharged sheet stopper 67 may be moved in the direction of an arrow "c" of FIG. 8. Further, it is displaced to an optimum position in accordance with the sheet size by a drive unit (not shown) to vary the position of the folded sheet accommodated on the sheet stacking surface 50*a*.

While in this embodiment the position of the discharged sheet stopper 67 as the sheet end regulating member is movable in the direction indicated by the arrow "c", it is also possible for the sheet end regulating member to be formed so as to be capable of making appearance at an optimum position according to the sheet size.

As illustrated in FIG. 8, in the vicinity of the discharge port 50*b* formed in the sheet stacking surface 50*a*, there is provided a movable lever member 68 which raises the trailing end of the folded sheet when the folded sheet is conveyed onto the sheet stacking surface 50*a* and which reliably discharges the folded sheet onto the sheet stacking surface 50*a* from the discharge port 50*b*.

Figure 12A:
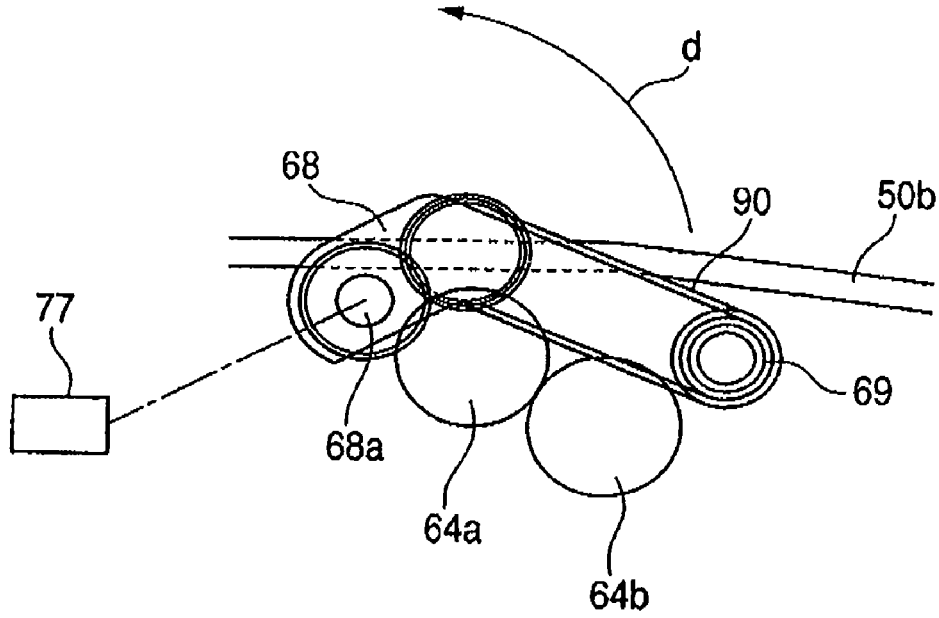
FIG. 12A is a diagram illustrating a movable lever, which is retracted.
Figure 12B:
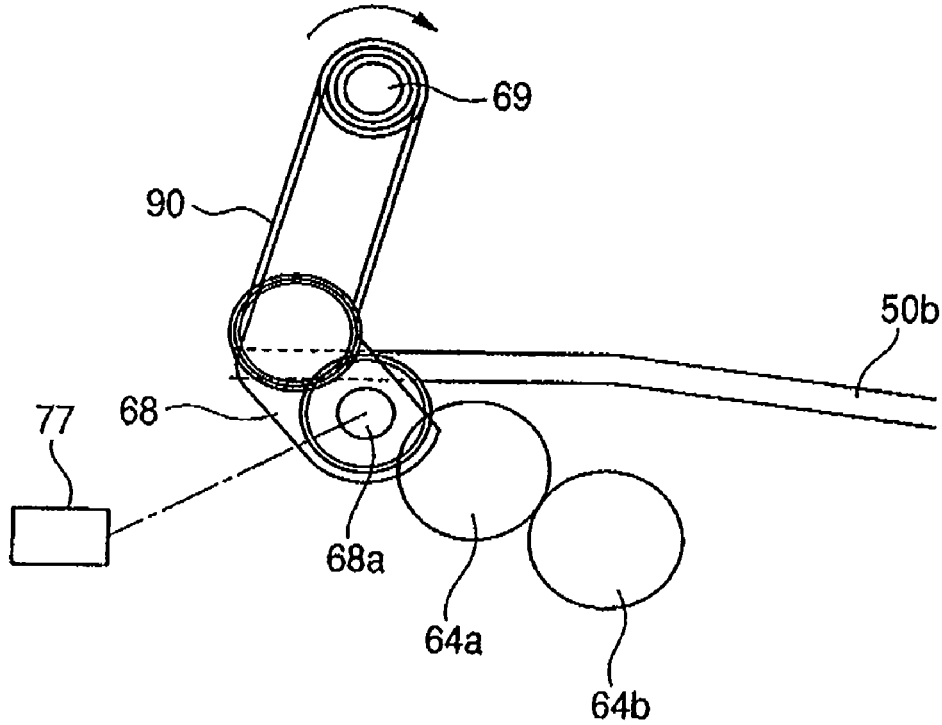
FIG. 12B is a diagram illustrating the movable lever, which is erected.

FIG. 12A illustrates the movable lever member as retracted. FIG. 12B illustrates the movable lever member as erected. The movable lever member 68 is arranged so as to be astride the pair of folding rollers 64 (64*a*, 64*b*), with one end thereof being rotatably supported by a support shaft 68*a*. The movable lever member 68 is connected, for example, to a drive mechanism 77 as a lever drive device, and is rotatable around the support shaft 68*a*. The other end of the movable lever member 68 discharges the trailing end of the folded sheet to the downstream side (in the direction indicated by the arrow "d" in FIGS. 8 and 12A) of the sheet stacking surface 50*a* from the discharge port 50*b* through rotation of the movable lever member 68. Further, at the other end of the movable lever member 68, there is provided, for example, an eject roller 69 serving as a drive roller which discharge-drives the folded sheet so as to discharge the folded sheet onto the sheet stacking surface 50*a* in the discharging direction.

The movable lever member 68 operates at the point in time when the trailing end of the folded sheet discharged to the discharge port 50*b* by the pair of folding rollers 64 passes the pair of folding rollers 64. More specifically, as illustrated in FIG. 12A, the eject roller 69 provided at the end of the movable lever member 68 rotates around the support shaft 68*a* in the direction indicated by the arrow "d" in FIG. 12A, and pushes up the trailing end of the folded sheet to guide the folded sheet onto the sheet stacking surface 50*a* of the first stack tray 50.

The eject roller 69 is rotated clockwise in FIG. 12B by a belt 90 run by a drive motor (not shown) and prevents movement of the sheet bundle in a direction opposite to the discharged sheet stopper 67 side through rotation of the movable lever member 68.

(Saddle-Binding/Saddle-Folding Operation)

Next, the saddle binding and saddle folding operations will be described. First, the sheet bundle P, gathered by the delivery roller pair 22 so as to extend on both the processing tray 14 and the processing route 60, is aligned through execution of alignment operation at the alignment portion 12. The aligned sheet bundle P is gripped by the gripper unit 40, and is pushed out from the processing tray 14 such that substantially the center of the sheet bundle P is situated at the saddle binding position SP2.

Further, when the center of the sheet bundle P reaches the saddle binding position SP2, the staple head unit 61 is operated, and saddle binding is effected at predetermined two positions by the staple head unit 61 and the anvil head 62. When the saddle binding is completed, the gripping of the gripper unit 40 on the sheet bundle P is released, and one roller of the pair of fold conveying rollers 65 is brought into pressure contact with the other roller. At the same time, one runner of the conveying runner pair 66 is brought into pressure contact with the other runner. As a result, the sheet bundle P is held between the conveying roller pair 65 and the conveying runner pair 66. Then, the conveying roller pair 65 is driven to perform conveyance until substantially the center of the sheet bundle P reaches the folding position FP (see FIG. 8).

Figure 9A:
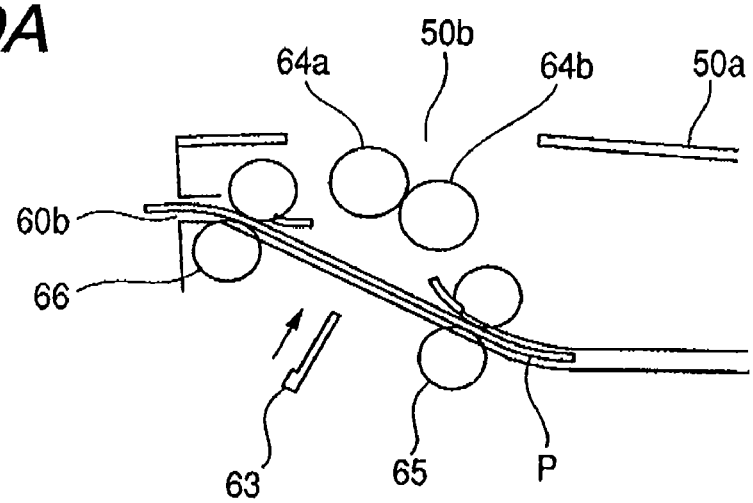
FIGS. 9A, 9B, and 9C are schematic views illustrating a saddle folding operation by the saddle unit of the sheet processing apparatus of FIG. 2.
Figure 9B:
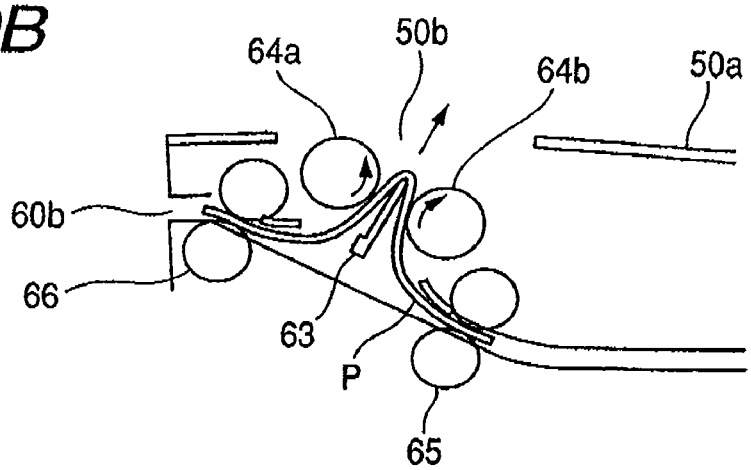

When substantially the center of the sheet bundle reaches the folding position FP, the folding blade 63 is operated as illustrated in FIG. 9A. As a result, the folding blade 63 advances toward the nip portion of the pair of folding rollers 64 (64*a*, 64*b*) while pressing the central portion of the sheet bundle P. That is, the folding blade 63 advances toward the sheet stacking surface 50*a* of the first stack tray 50, and, as illustrated in FIG. 9B, the saddle binding portion at the center of the sheet bundle P is pressed so as to be forced into the nip portion of the pair of folding rollers 64. At this time, the pair of folding rollers 64 also rotate simultaneously with the operation of the folding blade 63.

Through the proceeding operation of the folding blade 63 into the nip portion of the pair of folding rollers 64 and the rotation of the pair of folding rollers 64, the sheet bundle P is held between the pair of folding rollers 64, starting with the central portion thereof, and is conveyed toward the discharge port 50*b*. The folding blade 63 advances until the forward end thereof reaches a predetermined position that is past the nip position of the pair of folding rollers 64. At the point in time when the sheet bundle P is held between the pair of folding rollers 64, the folding blade 63 retreats to a predetermined standby position. At this time, the folding conveying roller pair 65 and the folding conveying runner pair 66 are respectively separated to release the gripping of the sheet bundle.

Figure 9C:
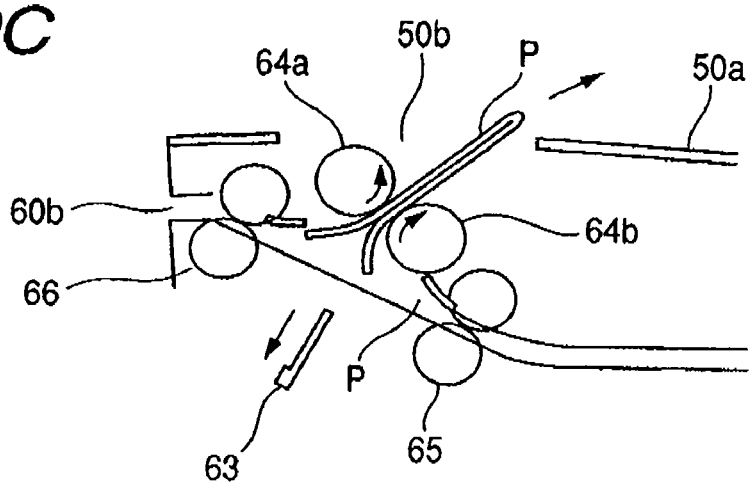

When the folding blade 63 retreats to pass the nip position of the pair of folding rollers 64, and is separated from the sheet bundle P, the other roller 64*b* of the pair of folding rollers 64 revolves with respect to one roller 64*a* as illustrated in FIG. 9C to deflect the pressure contact direction. As a result, the direction in which the sheet bundle P is discharged by the pair of folding rollers 64 is changed, and the sheet bundle is smoothly discharged onto the sheet stacking surface 50*a* of the first stack tray 50. Further, at the point in time when the trailing end of the sheet bundle to be discharged passes the pair of folding rollers 64, the above-mentioned movable lever member 68 is operated. While the movable lever member 68 is rotated, the trailing end side of the sheet bundle is pushed up by the eject roller 69 provided at the end of the movable lever member 68, thereby guiding the sheet bundle P onto the sheet stacking surface 50*a* of the first stack tray 50. Further, the movable lever member 68 is rotated from the initial first position to the second position where the sheet bundle P is to be lifted, and is then rotated back to the first position to be placed in a standby state.

Further, when the next sheet bundle is aligned on the processing tray 14, similar saddle binding and saddle folding operations are executed, and the succeeding sheet bundle is inserted and stacked under the preceding sheet bundle discharged onto the sheet stacking surface 50*a* of the first stack tray 50. That is, the succeeding sheet bundle is discharged under the lowermost sheet bundle of multiple sheet bundles stacked on the sheet stacking surface 50*a*. A rib (not shown) is provided on the sheet stacking surface 50*a* of the first stack tray 50. A vertex of the rib upstream of the discharge port 50*b* is above the sheet stacking surface 50*a* downstream of the discharge port 50*b*. Therefore, when the first stack tray 50 is located in the first position, the leading end of a discharging sheet does not enter the discharge port 50*b*.

(Second Stack Tray 51)

The above-mentioned second stack tray 51 is formed, for example, by resin molding in a configuration allowing stacking of sheets. A level sensor 80 for detecting the sheet stacking height is mounted to the processing portion 9 side frame of the second stack tray 51. Further, according to the amount of sheets stacked on the sheet stacking surface 51*a*, the position of the second stack tray 51 is lowered.

As described above in detail, according to the present invention, when separately accommodating sheets, such as sheets, sheets to be subjected to processing such as binding or folding, interruption sheets, and overflow sheets in the multiple trays, the folded sheets and the unprocessed sheets are stacked on the same stacking surface. As a result, it is possible to reduce the number of trays, and the tray unit may be compactly formed in a small size and at low cost.

The number of trays may be reduced as described above, and hence the tray unit as a whole is compactly formed in a small size. Further, it is possible to form in a small size and at low cost a lifting/lowering mechanism for selectively causing multiple tray units formed in multiple vertical stages to face the sheet delivery port.

The present invention is not restricted to the embodiment described above but allows various modifications without departing from the gist thereof. Such modifications are not to be excluded from the scope of the present invention.

For example, while in this embodiment the arm member 33 and the shift roller 30 are used as the alignment device, this should not be construed restrictively. It is also possible to use a jogger as the alignment device.

Further, for example, while in this embodiment the gripper unit 40 is used as the sheet delivery device, this should not be construed restrictively. It is also possible to use a delivery roller as the sheet delivery device.

Figure 10:
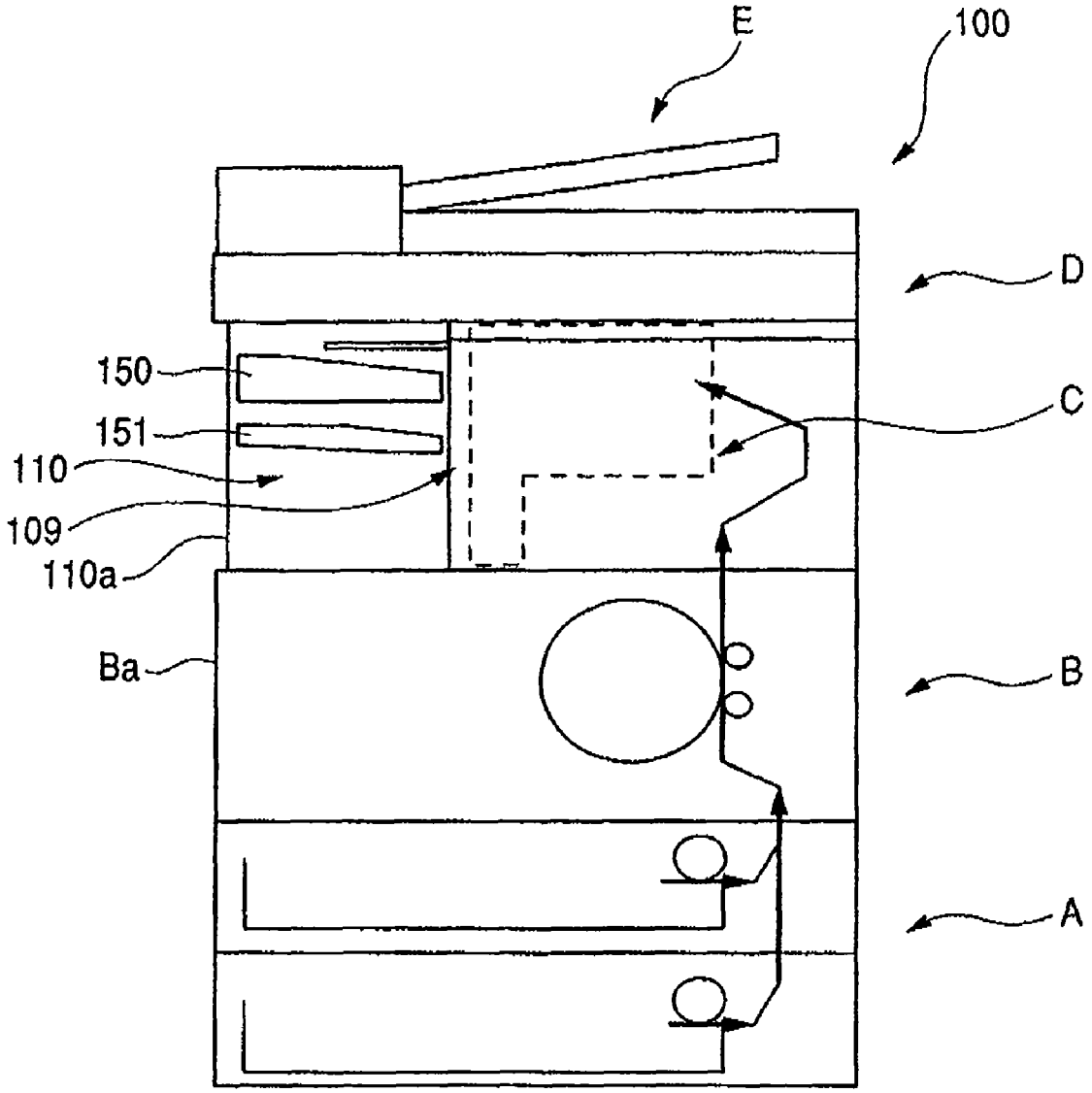
FIG. 10 is a diagram illustrating a modification of an image forming system according to an embodiment of the present invention.

FIG. 10 illustrates a modification of the image forming system. The processing apparatus C of an image forming system 100 has a processing portion 109 and an accommodating portion 110. The accommodating portion 110 does not stick out of a side surface Ba of the image forming apparatus B. A side surface 110*a* of the accommodating portion 110 is recessed with respect to the side surface Ba of the image forming apparatus B. As a result, the stack trays 150 and 151 do not protrude to the exterior of the image forming apparatus B or the original reading apparatus D.

The present invention relates to a sheet processing apparatus for performing a processing such as binding, punching, or stamping on sheets delivered from an image forming apparatus such as a copying machine or a printer. In particular, the present invention relates to a sheet processing apparatus in which multiple trays for accommodating sheet bundles are arranged in a limited space in an image forming apparatus and in which sheet bundles are stacked and accommodated on a tray selected through switching according to the processing mode, thus providing industrial applicability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2008-014292 filed Jan. 24, 2008, Japanese Patent Application No. 2008-014293 filed Jan. 24, 2008, and Japanese Patent Application No. 2008-014294 filed Jan. 24, 2008, which are hereby incorporated by reference herein in their entirety.

What is claimed is:

1. A sheet processing apparatus, comprising:

a stack tray on which a sheet successively delivered from a delivery port is stacked, the stack tray including:

a folding route receiving the sheet from the delivery port;

a sheet folding device provided in the folding route to fold the sheet; and a sheet stacking surface for stacking the sheet, wherein the sheet processing apparatus is operable selectively between a first mode in which a sheet from the delivery port is stacked on the sheet stacking surface of the stack tray, and a second mode in which a sheet folded by the sheet folding device is stacked on the sheet stacking surface.

2. A sheet processing apparatus according to claim 1, further comprising a shift device for lifting and lowering the stack tray.

3. A sheet processing apparatus according to claim 1, wherein, in the first mode, a shift device moves the stack tray to a first position so as to stack the sheet from the delivery port on the sheet stacking surface of the stack tray, and wherein, in the second mode, the shift device moves the stack tray to a second position so that the folding route receives the sheet from the delivery port.

4. A sheet processing apparatus according to claim 1, wherein the stack tray has a tray housing which contains a binding device provided in the folding route so as to bind sheets and the sheet folding device for folding the bound sheets, and wherein the tray housing has the sheet stacking surface on an upper portion of the tray housing.

5. A sheet processing apparatus according to claim 1, further comprising a processing tray for delivering a sheet to the stack tray, wherein the processing tray has an alignment device for aligning sheets at a predetermined alignment position, and a sheet delivery device for delivering the aligned sheets to the stack tray.

6. A sheet processing apparatus according to claim 5, wherein the processing tray has an end binding device for binding an end of the sheets aligned by the alignment device.

7. A sheet processing apparatus according to claim 2, further comprising another stack tray on which a sheet from the delivery port is stacked, wherein the shift device selectively causes the sheet stacking surface of the stack tray, the folding route of the stack tray, and the another stack tray to face the delivery port.

8. A sheet processing apparatus according to claim 2, further comprising an abutment portion, wherein the shift device presses the sheet stacked on the sheet stacking surface against the abutment portion, to thereby sharpen a fold of the sheet stacked on the sheet stacking surface.

9. A sheet processing apparatus according to claim 1, wherein the sheet stacking surface is arranged above the folding route, and wherein, in the second mode, the folded sheet is discharged upwards from below the sheet stacking surface and stacked at a lowermost level of the sheet already stacked on the sheet stacking surface.

10. A sheet processing apparatus according to claim 9, wherein the stack tray is provided with a sheet end regulating member for regulating an end of the sheet stacked on the sheet stacking surface, and wherein the sheet end regulating member regulates the end of the sheet according to a size of the sheet so that the sheet stacked on the sheet stacking surface overlaps with a discharge port leading from the folding route to the sheet stacking surface.

11. A sheet processing apparatus according to claim 9, wherein the stack tray is provided with a movable lever member pushing up a trailing end of the folded sheet, and a lever drive device operating the movable lever member.

12. A sheet processing apparatus according to claim 11, wherein the movable lever member discharges the sheet to a downstream side of the discharge port leading from the folding route to the sheet stacking surface, and wherein the movable lever member has a drive roller for discharging the sheet to be discharged in a direction in which the sheet is discharged to the sheet stacking surface.

13. A sheet processing apparatus according to claim 9, wherein the stack tray is provided with a binding device arranged along the folding route so as to bind a central portion of a sheet, wherein the sheet folding device has a pair of folding rollers in pressure contact with each other and arranged in a vicinity of a discharge port leading from the folding route to the sheet stacking surface, and a folding blade that bends the central portion of the bound sheet and inserts the central portion of the bound sheet between the pair of folding rollers, and wherein one roller of the pair of folding rollers comprises a revolving roller rolling on a peripheral surface of the other roller thereof, and a pressure contact position of the revolving roller with the sheet is moved on the peripheral surface of the other roller while the sheet is discharged onto the sheet stacking surface.

14. A sheet processing apparatus according to claim 13, wherein the revolving roller first discharges a leading end of the sheet from the discharge port in a direction substantially orthogonal to the folding route, and then pushes out a trailing end of the sheet along the sheet stacking surface through movement of the pressure contact position with respect to the sheet.

15. A sheet processing apparatus according to claim 1, wherein the folding route is formed as a substantially U-shaped route so that the folded sheet is discharged onto the sheet stacking surface of the stack tray such that a folded end of the sheet folded by the sheet folding device is directed to an upstream side with respect to a direction in which the sheet is delivered from the delivery port to the folding route.

16. A sheet processing apparatus according to claim 15, wherein the sheet stacking surface of the stack tray is arranged above the folding route so as to be substantially parallel to the folding route.

17. A sheet processing apparatus according to claim 3, wherein the shift device moves the stack tray between to the first position and the second position based on a sheet processing mode signal from outside.

18. An image forming apparatus comprising:

an image forming portion for forming an image on a sheet; and a sheet processing apparatus according to claim 1 for processing the sheet delivered from the image forming portion.

19. An image forming apparatus according to claim 18, further comprising an original reading apparatus for reading an image of an original, wherein the sheet processing apparatus is arranged above the image forming portion and below the original reading apparatus, and wherein the sheet processing apparatus receives the sheet from below and discharges a processed sheet between the image forming portion and the original reading apparatus.

20. An image forming apparatus according to claim 18, wherein the sheet processing apparatus is not stuck out of a side surface of the image forming portion.

* * * * *